US010992019B2

(12) United States Patent
Chueh

(10) Patent No.: US 10,992,019 B2
(45) Date of Patent: Apr. 27, 2021

(54) POWER DIVIDING CIRCUIT AND POWER DIVIDER

(71) Applicant: NANNING FUGUI PRECISION INDUSTRIAL CO., LTD., Nanning (CN)

(72) Inventor: Yu-Chih Chueh, New Taipei (TW)

(73) Assignee: NANNING FUGUI PRECISION INDUSTRIAL CO., LTD., Nanning (CN)

( * ) Notice: Subject to any disclaimer, the term of this patent is extended or adjusted under 35 U.S.C. 154(b) by 0 days.

(21) Appl. No.: 16/433,573

(22) Filed: Jun. 6, 2019

(65) Prior Publication Data

US 2020/0388900 A1 Dec. 10, 2020

(51) Int. Cl.
*H01P 5/18* (2006.01)

(52) U.S. Cl.
CPC ..... *H01P 5/184* (2013.01)

(58) Field of Classification Search
CPC ..... H01P 5/12; H01P 5/184
USPC ..... 333/116
See application file for complete search history.

(56) References Cited

FOREIGN PATENT DOCUMENTS

CN 107634298 A * 1/2018
CN 107634298 A 1/2018

* cited by examiner

*Primary Examiner* — Robert J Pascal
*Assistant Examiner* — Kimberly E Glenn
(74) *Attorney, Agent, or Firm* — ScienBiziP, P.C.

(57) ABSTRACT

A small scale power divider which is less susceptible to large tolerances in the manufacture includes a substrate and a power dividing circuit thereon. The power dividing circuit includes an input port, a first output port, a second output port, an impedance converter, a first microstrip line, and a second microstrip line. An end of the first microstrip line is connected to the impedance converter, another end of the first microstrip line is connected to the first output port. An end of the second microstrip line is connected to the impedance converter, another end of the second microstrip line is connected the second output port.

16 Claims, 5 Drawing Sheets

POWER DIVIDING CIRCUIT AND POWER DIVIDER

FIELD

The subject matter herein generally relates to power supplies.

BACKGROUND

A Wilson power divider has advantages of a simple structure, 3-dB power distribution, and good isolation between the outputs, thus it is often used in power combining application circuits and feed networks for array antennas.

Performing 3-dB power distribution at design frequency, the Wilson power divider includes two 70.7 ohm quarter-wave transmission lines. However, when using a thin substrate having dielectric constant, a line width (typically 0.096 mm) of the Wilson power divider is very narrow, and the narrower line width is more sensitive to lack of precision in manufacturing.

There is room for improvement within the art.

BRIEF DESCRIPTION OF THE DRAWINGS

Implementations of the present disclosure will now be described, by way of embodiment, with reference to the attached figures.

DETAILED DESCRIPTION

Figure 1:
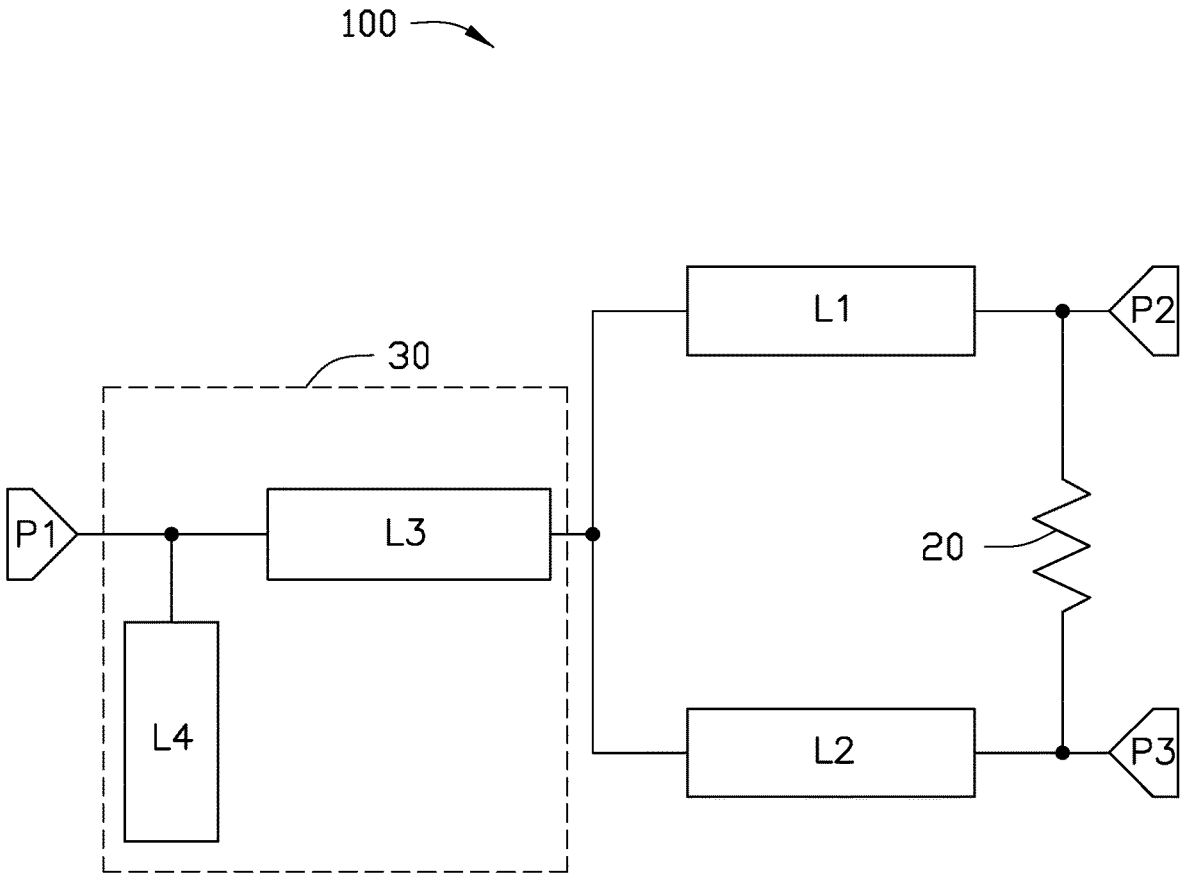
FIG. 1 is a circuit diagram of an exemplary embodiment of a power divider.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising" when utilized, means "including, but not necessarily limited to"; it specifically indicates open-ended inclusion or membership in the so-described combination, group, series, and the like.

The present disclosure is described in relation to power dividing circuits and a power divider.

FIG. 1 illustrates a power divider 100. The power divider 100 can be applied to a circuit or a device requiring several different levels of power and an antenna feed network.

Figure 2:
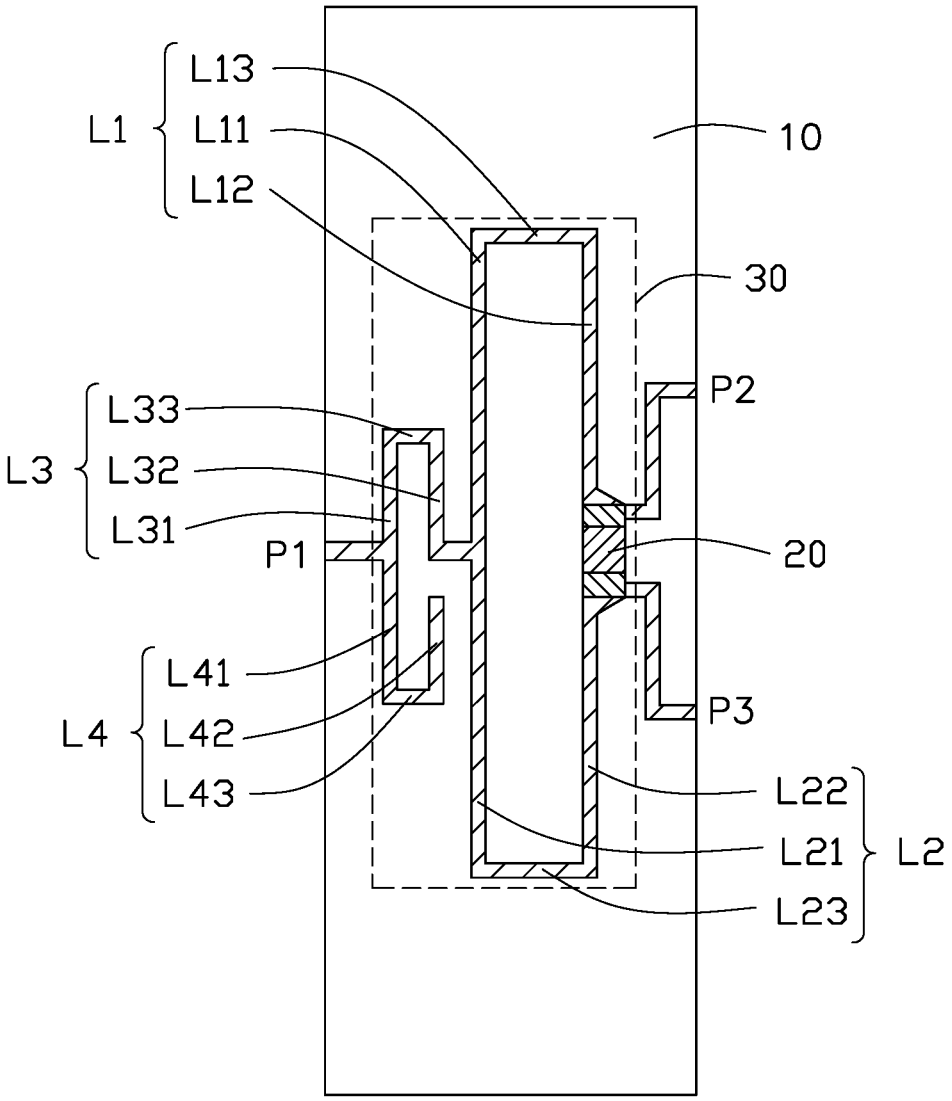
FIG. 2 is an isometric view of an exemplary embodiment of the power divider of FIG. 1.

Referring to FIG. 2, the power divider 100 includes a substrate 10, an input port P1, a first output port P2, a second output port P3, an isolation element 20, a first microstrip line L1, a second microstrip line L2, and an impedance converter 30. The input port P1, the first output port P2, the second output port P3, the first microstrip line L1, the second microstrip line L2, and the impedance converter 30 form a power dividing circuit on the substrate 10.

Each of the first output port P2 and the second output port P3 is configured for connecting to a matching load.

The isolation element 20 is electrically connected between the first output port P2 and the second output port P3 to ensure isolation therebetween. In this embodiment, the isolation element 20 is a resistor having an impedance of 100 ohms. In other embodiment, the isolation element 20 may be omitted as long as an isolation of the power divider 100 can meet practical application requirements.

An end of the first microstrip line L1 and an end of the second microstrip line L2 are connected to the impedance converter 30. Another end of the first microstrip line L1 is connected to the first output port P2. Another end of the second microstrip line L2 is connected the second output port P3.

In this embodiment, the first microstrip line L1 and the second microstrip line L2 both have an impedance of 50 ohms and a wave length of 90 degrees (i.e., a quarter wavelength). In this embodiment, the first microstrip line L1 and the second microstrip line L2 have a line width of 0.2 mm.

Referring to FIG. 2, the first microstrip line L1 is substantially U-shaped, and includes a first bending section L11, a second bending section L12, and a first connecting section L13. The first bending section L11 is parallel to and apart from the second bending section L12. The first connecting section L13 is positioned between the first bending section L11 and the second bending section L12. Two ends of the first connecting section L13 are perpendicularly connected to the first bending section L11 and the second bending section L12.

A structure of the second microstrip line L2 is substantially the same as that of the first microstrip line L1. Microstrip line L2 is also substantially U-shaped, and includes a third bending section L21, a fourth bending section L22, and a second connecting section L23. The third bending section L21 is parallel to and apart from the fourth bending section L22. The second connecting section L23 is positioned between the third bending section L21 and the third bending section L22. Two ends of the second connecting section L23 are perpendicularly connected to the third bending section L21 and the fourth bending section L22. An end of the third bending section L21 opposite to the second connecting section L23 is connected to the first bending section L11. The fourth bending end L22 and the second bending end 12 are collinear. The isolation element 20 is positioned between the second bending section L12 and the fourth bending section L22. Thus, the first microstrip line L1, the second microstrip line L2, and the isolation element 20 cooperatively form a closed rectangular structure.

In this embodiment, the impedance transformer 30 includes a third microstrip line L3 and a fourth microstrip line L4. The impedance converter 30 is configured for matching impedances of the input port P1 and the first and second output ports P2 and P3. In this embodiment, the impedance transformer 30 has a length of 7.2 mm and a width of 2.7 mm.

In this embodiment, an end of the third microstrip line L3 is connected to the input port P1, and another end of the third microstrip line L3 is connected to the first microstrip line L1 and the second microstrip line L2. An end of the fourth microstrip line L4 is connected between the input port P1 and the third microstrip line L3, and other end of the fourth microstrip line L4 is in an open state.

In this embodiment, the third microstrip line L3 and the fourth microstrip line L4 both have an impedance of 50 ohms and a wave length of 35.26 degrees. Each line width of the third microstrip line L3 and the fourth microstrip line L4 is 0.2 mm.

Referring to FIG. 2, the third microstrip line L3 is substantially U-shaped, and includes a fifth bending section L31, a sixth bending section L32, and a third connecting section L33. The fifth bending section L31 is parallel to and apart from the sixth bending section L32. The third connecting section L33 is positioned between the fifth bending section L31 and the sixth bending section L32. Two ends of the third connecting section L33 are perpendicularly connected to the fifth bending section L31 and the sixth bending section L32.

A structure of the fourth microstrip line L4 is substantially the same as that of the third microstrip line L3. The fourth microstrip line L4 is also substantially U-shaped, and includes a seventh bending section L41, an eighth bending section L42, and a fourth connecting section L43. The seventh bending section L41 is parallel to and apart from the eighth bending section L42. The fourth connecting section L43 is positioned between the seventh bending section L41 and the eighth bending section L42. Two ends of the fourth connecting section L43 and the seventh bending section L41 are perpendicularly connected to the eighth bending section L42. An end of the seventh bending section L41 opposite to the fourth connecting section L43 is connected to the fifth bending section L31. The eighth bending end L42 and the sixth bending end 32 are collinear. The third microstrip line L3 and the fourth microstrip line L4 cooperatively form a rectangular structure having an opening.

Figure 3:
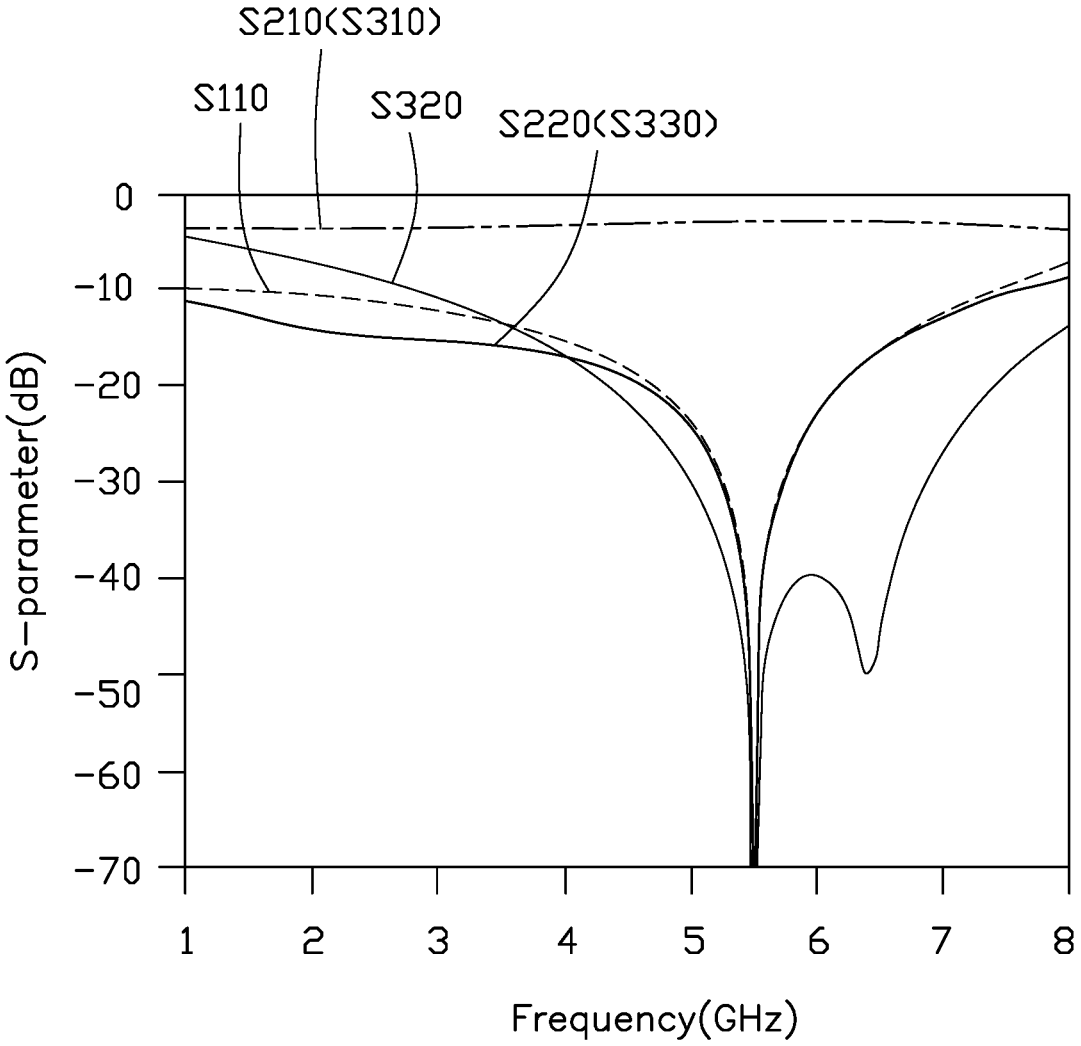
FIG. 3 is a diagram showing a simulation of the power divider of FIG. 2 when the power divider operates at a frequency of 5.5 GHz.

FIG. 3 illustrates a simulation of the power divider 100 in one embodiment when the power divider 100 operates at a frequency of 5.5 GHz. As shown in FIG. 3, a horizontal axis represents frequencies, and a vertical axis represents S-parameters. Curve S110 represents an insertion loss of the power divider 100 at the input port P1. Curve S210 represents an insertion loss of the power divider 100 from output port P2 to the input port P1 when the impedance of the input port P1 is matched. Curve S310 represents an insertion loss of the power divider 100 from the second output port P3 to the input port P1 when the impedance of the input port P1 is matched. As shown in FIG. 3, curve S210 and curve S310 almost coincide with each other. Curve S320 represents isolation between the first output port P2 and the second output port P3. Curve S220 represents an insertion loss of the power divider 100 at the first output port P2. Curve S330 represents an insertion loss of the power divider 100 at the second output port P3. Curve S220 and curve S330 almost coincide with each other.

Figure 4:
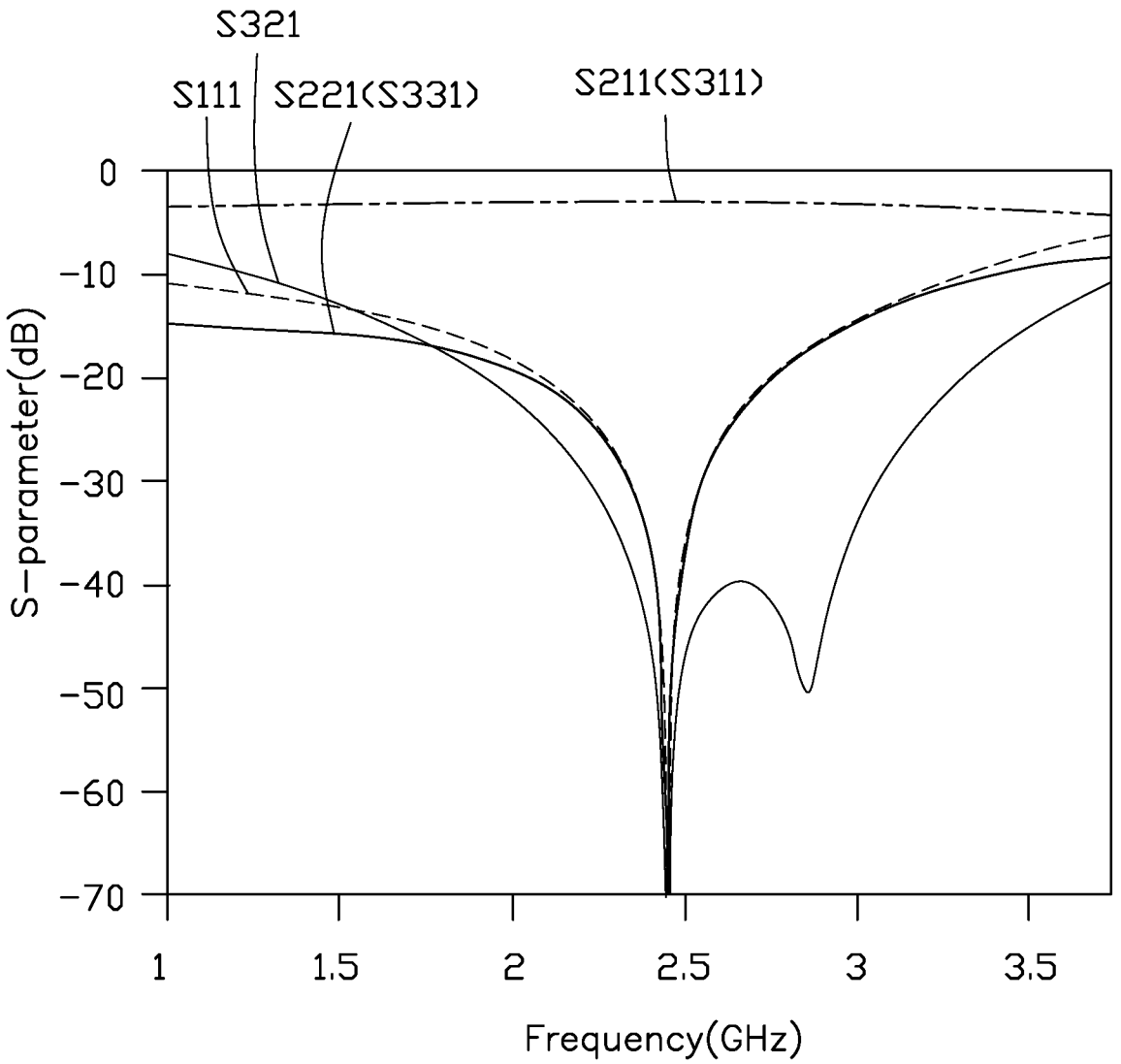
FIG. 4 is a diagram showing a simulation of the power divider of FIG. 2 when the power divider operates at a frequency of 2.45 GHz.

FIG. 4 illustrates simulation of the power divider 100 in one embodiment when the power divider 100 operates at a frequency of 2.45 GHz. As shown in FIG. 4, a horizontal axis represents frequencies, and a vertical axis represents S-parameters. Curve S211 represents an insertion loss of the power divider 100 at the input port P1. Curve S211 represents an insertion loss of the power divider 100 from output port P2 to the input port P1 when the impedance of the input port P1 is matched. Curve S311 represents an insertion loss of the power divider 100 from the second output port P3 to the input port P1 when the impedance of the input port P1 is matched. As shown in FIG. 4, curve S211 and curve S311 are almost coincidental. Curve S321 represents an isolation between the first output port P2 and the second output port P3. Curve S221 represents an insertion loss of the power divider 100 at the first output port P2. Curve S331 represents an insertion loss of the power divider 100 at the second output port P3. Curve S221 and curve S331 are almost coincidental.

It can be seen from simulation results in FIG. 3 and FIG. 4, the input port P1 (curves S110, S111), the first output port P2 (curves S220, S221), and the second output port (curve S330, S331) have a return loss of at least 18 dB. The two output ports (curves S320, S321) have an isolation of 24 dB. Thus, each port of the power divider 100 has better matching performance and degree of isolation.

In this embodiment, the substrate 10 has a height of 0.12 mm and a width of 4 mm. The substrate 10 is made of FR4 material and has a loss tangent of 0.02.

Figure 5:
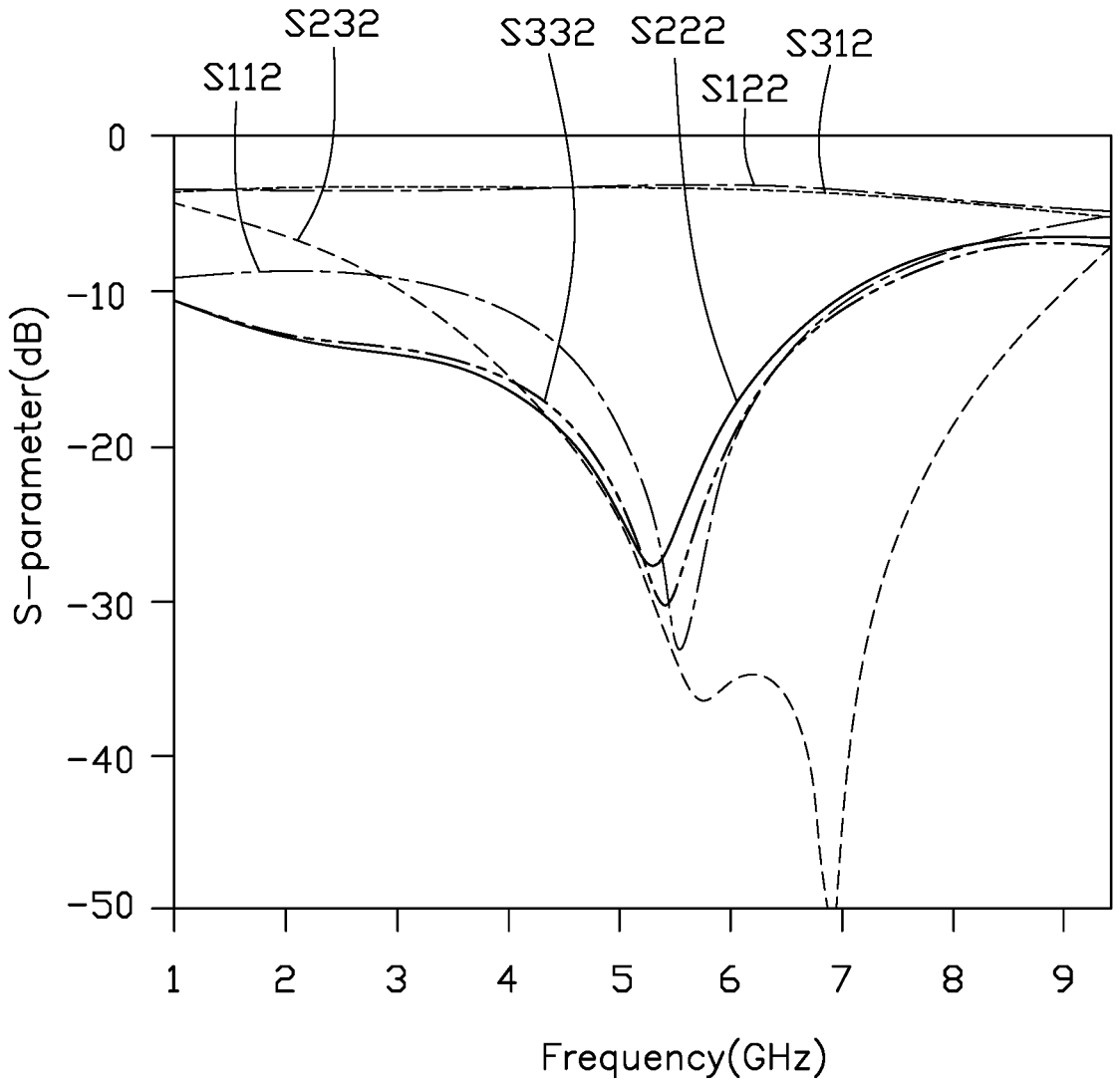
FIG. 5 is a diagram showing a simulation of the power divider in another embodiment when the power divider operates at a frequency of 5.5 GHz.

FIG. 5 illustrates a simulation of the power divider 100 in one embodiment when the power divider 100 operates at a frequency of 5.5 GHz. As shown in FIG. 5, a horizontal axis represents frequencies, and a vertical axis represents S-parameters. Curve S112 represents an insertion loss of the power divider 100 at the input port P1. Curve S122 represents an insertion loss of the power divider 100 from output port P2 to the input port P1 when the impedance of the input port P1 is matched. Curve S312 represents an insertion loss of the power divider 100 from the second output port P3 to the input port P1 when the impedance of the input port P1 is matched. Curve 232 represents an isolation between the first output port P2 and the second output port P3. Curve S222 represents an insertion loss of the power divider 100 at the first output port P2. Curve S332 represents an insertion loss of the power divider 100 at the second output port P3.

It can be seen from simulation results in FIG. 5, the input port P1 (curves S112), the first output port P2 (curves S222), and the second output port (curve S332) have a return loss of at least 18 dB. The two output ports (curves S232) have an isolation of 24 dB. Thus, each port of the power divider 100 has better matching performance and degree of isolation.

Therefore, the power divider 100 can be positioned on a thin substrate having a higher dielectric constant in any operating frequency band (e.g. 5.5 GHz, 2.45 GHz), and still has better matching performance at each port. In addition, the power divider 100 can be constructed on a thin substrate, and the line widths of the first to fourth microstrip lines L1-L4, having line widths of 0.2 mm, renders large manufacturing tolerances irrelevant.

The embodiments shown and described above are only examples. Many details are often found in the relevant art. Therefore, many such details are neither shown nor described. Even though numerous characteristics and advantages of the present disclosure have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A power divider comprising:

a substrate, a power dividing circuit, the power dividing circuit positioned on the substrate, the power dividing circuit comprising:

an input port;

a first output port;

a second output port;

an impedance converter;

a first microstrip line, wherein an end of the first microstrip line is connected to the impedance converter, another end of the first microstrip line is connected to the first output port; and a second microstrip line, wherein an end of the second microstrip line is connected to the impedance converter, another end of the second microstrip line is connected the second output port, wherein the impedance converter comprises a third microstrip line and a fourth microstrip line, an end of the third microstrip line is connected to the input port, and another end of the third microstrip line is connected to the first microstrip line and the second microstrip line, an end of the fourth microstrip line is connected between the input port and the third microstrip line, and another other end of the fourth microstrip line is in an open state;

wherein each of the first microstrip line and the second microstrip line has an impedance of 50 ohms and an electrical length of 90 degrees; each of the third microstrip line and the fourth microstrip line has an impedance of 50 ohms and an electrical length of 35.26 degrees.

2. The power divider of claim 1, wherein the first microstrip line comprises a first bending section, a second bending section, and a first connecting section, the first bending section is parallel to and apart from the second bending section, the first connecting section is positioned between the first bending section and the second bending section, the two ends of the first connecting section are perpendicularly connected to the first bending section and the second bending section.

3. The power divider of claim 2, wherein the second microstrip line comprises a third bending section, a fourth bending section, and a second connecting section, the third bending section is parallel to and apart the fourth bending section, the second connecting section is positioned between the third bending section and the third bending section, two ends of the second connecting section are perpendicularly connected to the third bending section and the fourth bending section, an end of the third bending section opposite to the second connecting section is connected to the first bending section, the fourth bending end and the second bending end are collinear.

4. The power divider of claim 3, further comprising an isolation element, wherein the isolation element is positioned between the second bending section and the fourth bending section, the first microstrip line, the second microstrip line, and the isolation element cooperatively form a closed rectangular structure together.

5. The power divider of claim 4, wherein the isolation element is a resistor and has an impedance of 100 ohms.

6. The power divider of claim 1, wherein the third microstrip line comprises a fifth bending section, a sixth bending section, and a third connecting section, the fifth bending section is parallel to and apart from the sixth bending section, the third connecting section is positioned between the fifth bending section and the sixth bending section, two ends of the third connecting section are perpendicularly connected to the fifth bending section and the sixth bending section.

7. The power divider of claim 6, wherein the fourth microstrip line comprises a seventh bending section, an eighth bending section, and a fourth connecting section, the seventh bending section is parallel to and apart from the eighth bending section, the fourth connecting section is positioned between the seventh bending section and the eighth bending section, two ends of the fourth connecting section and the seventh bending section are perpendicularly connected to the eighth bending section, an end of the seventh bending section opposite to the fourth connecting section is connected to the fifth bending section, the eighth bending end and the sixth bending end are collinear, the third microstrip line and the fourth microstrip line cooperatively form a rectangular structure having an opening together.

8. The power divider of claim 1, wherein the substrate has a height of 0.12 mm, a width of 4 mm, and a loss tangent of 0.02.

9. The power divider of claim 8, wherein when the power divider operates at frequencies of 5.5 GHz and 2.45 GHz, an insertion loss of the power divider from the first output port to the input port is the same as that of the power divider from the second output port to the input port; an insertion loss of the power divider at the first output port is the same as that of the power divider at the second output port.

10. A power dividing circuit comprising:

an input port;

a first output port;

a second output port;

an impedance converter;

a first microstrip line, wherein an end of the first microstrip line is connected to the impedance converter, another end of the first microstrip line is connected to the first output port; and a second microstrip line, wherein an end of the second microstrip line is connected to the impedance converter, another end of the second microstrip line is connected the second output port, wherein the impedance converter comprises a third microstrip line and a fourth microstrip line, an end of the third microstrip line is connected to the input port, and another end of the third microstrip line is connected to the first microstrip line and the second microstrip line, an end of the fourth microstrip line is connected between the input port and the third microstrip line, and another other end of the fourth microstrip line is in an open state;

wherein each of the first microstrip line and the second microstrip line has an impedance of 50 ohms and an electrical length of 90 degrees; each of the third microstrip line and the fourth microstrip line has an impedance of 50 ohms and an electrical length of 35.26 degrees.

11. The power dividing circuit of claim 10, wherein the first microstrip line comprises a first bending section, a second bending section, and a first connecting section, the first bending section is parallel to and apart from the second bending section, the first connecting section is positioned between the first bending section and the second bending section, the two ends of the first connecting section are perpendicularly connected to the first bending section and the second bending section.

12. The power dividing circuit of claim 11, wherein the second microstrip line comprises a third bending section, a fourth bending section, and a second connecting section, the third bending section is parallel to and apart the fourth bending section, the second connecting section is positioned between the third bending section and the third bending section, two ends of the second connecting section are perpendicularly connected to the third bending section and the fourth bending section, an end of the third bending section opposite to the second connecting section is connected to the first bending section, the fourth bending end and the second bending end are collinear.

13. The power dividing circuit of claim 12, further comprising an isolation element, wherein the isolation element is positioned between the second bending section and the fourth bending section, the first microstrip line, the second microstrip line, and the isolation element cooperatively form a closed rectangular structure together.

14. The power dividing circuit of claim 13, wherein the isolation element is a resistor and has an impedance of 100 ohms.

15. The power dividing circuit of claim 10, wherein the third microstrip line comprises a fifth bending section, a sixth bending section, and a third connecting section, the fifth bending section is parallel to and apart from the sixth bending section, the third connecting section is positioned between the fifth bending section and the sixth bending section, two ends of the third connecting section are perpendicularly connected to the fifth bending section and the sixth bending section.

16. The power dividing circuit of claim 15, wherein the fourth microstrip line comprises a seventh bending section, an eighth bending section, and a fourth connecting section, the seventh bending section is parallel to and apart from the eighth bending section, the fourth connecting section is positioned between the seventh bending section and the eighth bending section, two ends of the fourth connecting section and the seventh bending section are perpendicularly connected to the eighth bending section, an end of the seventh bending section opposite to the fourth connecting section is connected to the fifth bending section, the eighth bending end and the sixth bending end are collinear, the third microstrip line and the fourth microstrip line cooperatively form a rectangular structure having an opening together.

* * * * *